US009091472B2

(12) United States Patent
Dziubasik et al.

(10) Patent No.: US 9,091,472 B2
(45) Date of Patent: Jul. 28, 2015

(54) NOZZLE FOR SPRAYING LIQUID, ESPECIALLY WATER IN A SNOW PRODUCTION CANNON

(71) Applicants: Damian Dziubasik, Poronin (PL); Tomasz Janos, DĘbno (PL)

(72) Inventors: Damian Dziubasik, Poronin (PL); Tomasz Janos, DĘbno (PL)

(73) Assignee: SUPERSNOW SPOLKA Z OGRANICZONA ODPOWIEDZIALNOSCIA, SPOLKA KOMANDYTOWA, Maniowy (PL)

( * ) Notice: Subject to any disclaimer, the term of this patent is extended or adjusted under 35 U.S.C. 154(b) by 0 days.

(21) Appl. No.: 14/003,819

(22) PCT Filed: Oct. 18, 2012

(86) PCT No.: PCT/PL2012/000108

§ 371 (c)(1),
(2) Date: Sep. 9, 2013

(87) PCT Pub. No.: WO2013/043068

PCT Pub. Date: Mar. 28, 2013

(65) Prior Publication Data

US 2013/0341423 A1 Dec. 26, 2013

(30) Foreign Application Priority Data

Jan. 13, 2012 (PL) ..... 397789

(51) Int. Cl.
*F25C 3/04* (2006.01)
*B05B 1/34* (2006.01)
(Continued)

(52) U.S. Cl.
CPC ... *F25C 3/04* (2013.01); *B05B 1/00* (2013.01); *B05B 1/3405* (2013.01);
(Continued)

(58) Field of Classification Search
CPC ..... A01G 15/00; E01H 13/00; F25C 3/04; F25C 2303/048; F25C 2303/0481; B05B 1/3073; B05B 1/12; B05B 1/308; B05B 15/065; B05B 1/3405; B05B 1/3436; B05B 1/3426; Y10S 239/04; Y10S 239/12; Y10S 239/19; F02M 61/168
USPC ..... 239/14.1, 14.2, 451, 456–458, 468, 239/491–493, 600, 602, DIG. 4, DIG. 19
See application file for complete search history.

(56) References Cited

U.S. PATENT DOCUMENTS 1,183,393 A * 5/1916 merrell et al. ..... 239/493
2,378,348 A * 6/1945 Wilmes et al. ..... 239/491
(Continued)

FOREIGN PATENT DOCUMENTS

| | | |
|---|---|---|
| CH | 659 592 | 2/1987 |
| DE | 933 235 | 9/1955 |
| DE | 202009012364 | 4/2010 |
| FR | 2 116 973 | 7/1972 |

*Primary Examiner* — Steven J Ganey
(74) *Attorney, Agent, or Firm* — Horst M. Kasper

(57) ABSTRACT

The invention relates to a nozzle for spraying liquid, especially water in a snow production cannon. The nozzle consists of a cylindrical body 1 and a cap nut 2 having an axial spraying hole 5 connected from inside by means of an inlet cone 6 to a vortex chamber 7. Between the body 1 and the nut 2 a swirl insert 4 is mounted. The insert divides a fluid supply channel 9 having a partition wall 8 with at least two vortex channels 10. The swirl insert 4 has a flange 11 which fixes the insert axially between the nut 2 and the body 1 through a front 12 and a rare 13 scaling rings, and both of said rings have circular cross-sections. The front sealing ring 12 is mounted in a rectangular groove made on the face of the swirl insert 4 tangent to the face of the nut 2. The rear sealing ring 13 is mounted in a semicircular socket IS made at the inner corner of the rear surface of the flange 11.

8 Claims, 2 Drawing Sheets

(51) Int. Cl.

| | |
|---|---|
| ***B05B 7/04*** | (2006.01) |
| ***B05B 15/06*** | (2006.01) |
| ***B05B 1/00*** | (2006.01) |
| *F02M 61/16* | (2006.01) |

(52) U.S. Cl.

CPC ..... *B05B 1/3421* (2013.01); *B05B 1/3426* (2013.01); *B05B 1/3436* (2013.01); *B05B 7/0433* (2013.01); *B05B 15/065* (2013.01); *F02M 61/168* (2013.01); *F25C 2303/0481* (2013.01); *Y10S 239/04* (2013.01); *Y10S 239/19* (2013.01)

(56) References Cited

U.S. PATENT DOCUMENTS

| | | | | | |
|---|---|---|---|---|---|
| 3,441,223 | A | * | 4/1969 | Lapera | 239/492 |
| 3,680,793 | A | * | 8/1972 | Tate et al. | 239/468 |
| 5,829,682 | A | | 11/1998 | Haruch | |
| 5,934,569 | A | * | 8/1999 | Soule et al. | 239/600 |
| 6,267,301 | B1 | | 7/2001 | Haruch | |
| 2007/0235564 | A1 | | 10/2007 | Whittaker et al. | |

* cited by examiner

NOZZLE FOR SPRAYING LIQUID, ESPECIALLY WATER IN A SNOW PRODUCTION CANNON

This invention relates to a nozzle for spraying liquid, especially for atomizing water in a snow production cannon. The nozzle is designed to atomize the liquid of low viscosity and mixtures of such liquids and gases, particularly air. Under conditions of increased contact area with environment liquid enters into effective physical and chemical transformations, for example, by change of state from liquid to solid.

The known spray nozzle, described in the patent specification DE 19723752 has a cylindrical body and a cup nut. A fitting with a spray hole and a swirl insert adhered to it on the back side of the inlet fluid channel are mounted between the body and the cup nut. The spray hole of the fitting is connected to the vortex chamber by means of an inlet cone. The swirl insert divides the fluid inlet channel by means of a wall. In the wall are made two vortex channels which axes are located symmetrically and swirl-oblique down the nozzle axis. The fitting and the swirl insert are made of industrial ceramics or sintered powders, which significantly increases resistance to erosive wear and is technically simpler. These elements are tightened by means of threaded connection of the nut to the body. Between the body and the swirl insert a flat sealing ring is located. The sealing ring is made of elastomeric material having flexible-elastic characteristic. Pressure through an elastic pad reduces the risk of damage to fragile ceramic elements which are sensitive to shock, vibration and exceeding the allowable assembly stress, especially in the state of compressive stress. The location of the nut in relation to the body is transient axially and there is a gap between the face of the nut and the flange of the body. The front surface of the fitting with the spray hole is tangent to the nut, moreover, the nozzle is not sealed in the plane of the contact of the swirl insert and the fitting, which may cause the leakage through threaded connection if the pressure of liquid is high. The effect of that can be adverse, such as causing icing.

There are also known nozzles for spraying liquids in which the spraying is supported by the compressed air energy. The swirl insert has an air nozzle in the axis of its partition wall and said air nozzle is fed with air by means of a coaxial pipe, the outside diameter of which is less than the diameter of the liquid inlet channel and which extends from the back of the body to the outsides. Such solutions are presented among other in the patent descriptions U.S. Pat. No. 4,101,073 and EP0855564. Compressed air introduced into a vortex chamber breaks liquid into fine particles and produces small ice crystals which in snow cannons act as nucleatory, the ice crystal nuclei which initiate the crystallization process of sprayed water.

The solution according to the present invention has, as the above described nozzles, cylindrical body and a cup nut with a fitting having a spray hole which is connected to the vortex chamber by means of an inlet cone. There is a swirl insert between the body and the nut. The swirl insert divides the fluid inlet channel by means of a wall. In the wall are made at least two vortex channels and the axes of said channels are located symmetrically and swirl-oblique down the nozzle axis. These elements of the nozzle are also tightened by means of sealing ring made of elastomeric material having flexible-elastic characteristic.

The essence of the invention consists in that the swirl insert has a flange by means of which it is axially fixed between the nut and the body through front and rear rings having circular cross-sections. The front ring is located in a rectangular groove made on the face of the swirl insert which is tangent to the nut face, while the rear sealing ring is located in a semicircular socket made at the inner corner of the rear surface of the flange. From the adjacent face of the body the rear sealing ring is encircled by a quadrant-of-a-circle socket having a cone input.

When the nut is fully tightened on the body the axial deformation of the rear sealing ring is from 20 to 40% of the diameter of its cross-section and at the same time a gap between the face of the flange and the face of the body is not greater than the deformation. The rear sealing ring is made of elastomeric material which hardness is in the range of 60 to 90 IRHD, and the hardness is grater than the hardness of the front sealing ring.

It is advantageous if the position of fully tightening of the nut on the body is determined by tightening the thread of the nut in the runout zone of the thread—at the specific torque value.

It is also advantageous if embodiment in which the position of fully tightening of the nut is determined by the contact of the face of the nut with the face of an abutment flange, made on the outer surface of the body.

The nut can be made as a single piece of metal, but at high pressures of fluid, it is advantageous if the nut has a fitting glued inside. The fitting is made of ceramic material or sintered powders and it has a spraying hole, a cone input and a flange. The front surface of said flange is tangent to the front surface of the swirl insert.

It is also advantageous if the swirl insert is made of ceramic material or sintered powders.

Further version of the invention consists on that the swirl insert has an air nozzle located in the axis of the partition wall, and said air nozzle is fed by means of a coaxial pipe, the outside diameter of which is less than the diameter of the liquid inlet channel and said pipe outstands from the back of the body.

According to the invention, the sealing rings which fix and seal the swirl insert work in non-standard conditions. The rear sealing ring works in non-closed socket, having non-standard shape and size. The ring is tightened against the surface in the slot zone by an initial tightening of the nut, and when the nozzle is working sealing effect is reinforced by liquid pressure. The space on the back of the ring does not bear any pressure. Initial tightening force is strictly determined by the position of the fully tightening of the nut. As a result, the reproducibility of the axial compression force of the prespecified value is obtained, and at the same time elasticity of the connection is preserved. Such conditions are particularly advantageous for nozzles with elements made of brittle ceramic material.

Two exemplary embodiments enable complete understanding of the invention. In the first embodiment the nozzle sprays water by energy of pressure, while in the second embodiment, water spraying is supported by compressed air. The nozzles are mounted circumferentially in many rows in the ring of the cylindrical body of snow cannons. The water nozzle is shown in FIGS. 1 to 5, and the second nozzle called nucleation nozzle is shown in FIGS. 6 to 8. The figures show:

FIG. 1 is an axial-section of the water nozzle having the cap nut with the ceramic insert built-into. The ceramic insert has a spraying hole. The nozzle is shown in the position before the full tightening of the nut, when the elements are in non-force contact.

Figure 1:
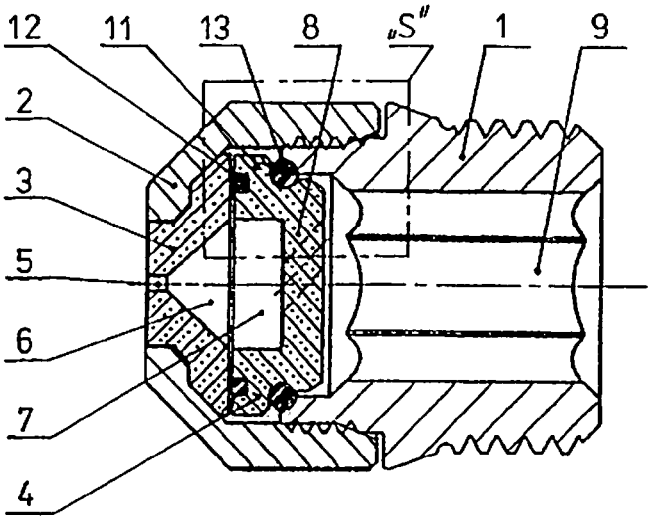

The nozzle shown in FIG. 1-5 consists of a cylindrical body 1, a cap nut 2 having a ceramic fitting 3 pasted-in, and a swirl insert 4. The nut 2 is made of nickel-plated brass. The ceramic fitting 3 has a spraying hole 5 situated in its axis, and said axial spraying hole 5 is connected from inside by means of an inlet cone 6 to the vortex chamber 7. Inside, between the body 1 and the nut 2 which are connected by screw joint, the swirl insert 4 is mounted. The swirl insert 4 is made of industrial ceramics. The insert 4 has a wall 8 dividing a water supply channel 9 in the body 1. There are two vortex channels 10 made in the wall 8, and the axes of said channels are situated symmetrically and swirly-obliquely around the axis of the water nozzle. The water supply channel 9 is supplied with water at a pressure of 8 to 40 bar. The swirl insert 4 is fixed between the nut 2 and a body 1 by a flange 11. The flange 11 is axially encircled by a front 12 and a rare 13 sealing rings which both have circular cross-sections of type "O". The sealing rings 12 and 13 are made of elastomeric material having flexible-elastic characteristic, for example fluorine rubber, nitrile rubber or butadiene-acrylonitrile rubber. The front sealing ring 12 is mounted in a rectangular groove 14 made on the face of the swirl insert 4 and said face is tangent to the face of the nut 2, while the rear sealing ring 13 is mounted in a semicircular socket 15 made at the inner corner of the rear surface of the flange 11. The rear sealing ring 13 is encircled from the side of the body 1 by a quadrant-of-a-circle socket 16 having a cone input 17. The diameter D of the rear sealing ring 13 is greater than the diameter d of the front sealing ring 12, in addition, the rear sealing ring 13 is made of nitrile rubber having hardness of 90 IRHD, while the front sealing ring 12 is made of butadiene-acrylonitrile rubber having hardness of 70 IRHD. The fluid supply channel 9 in the body 1 has a hexagonal cross-section, in order to facilitate screwing the body 1 into a ring of the cylinder of a snow cannon.

Figure 2:
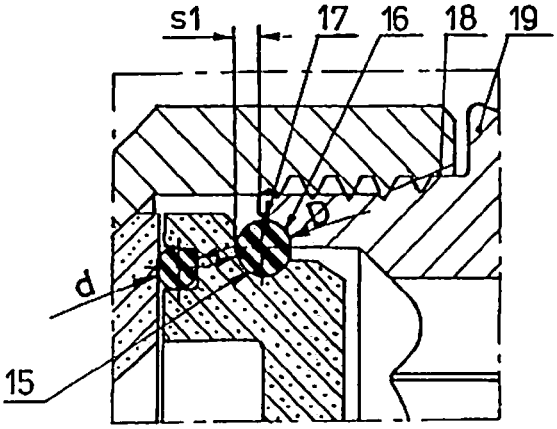
FIG. 2 shows the detail "s" of the FIG. 1, the locations of the sealing rings.
Figure 3:
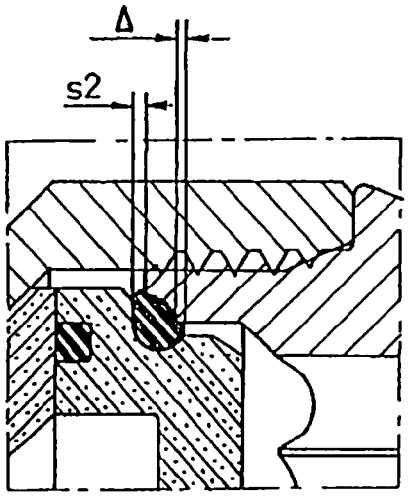
FIG. 3 shows the detail "s" the locations of the sealing after full tightening of the nut.
Figure 4:
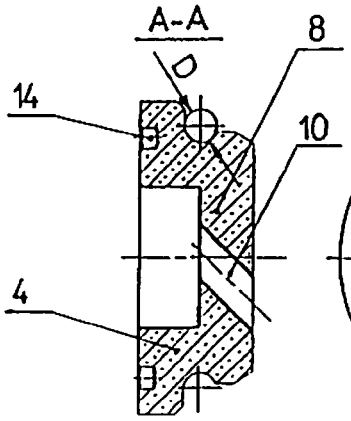
FIGS. 4 and 5 show the swirl insert respectively: in A-A section indicated in FIG. 5 and made through the swirl channel and in a front view.
Figure 5:
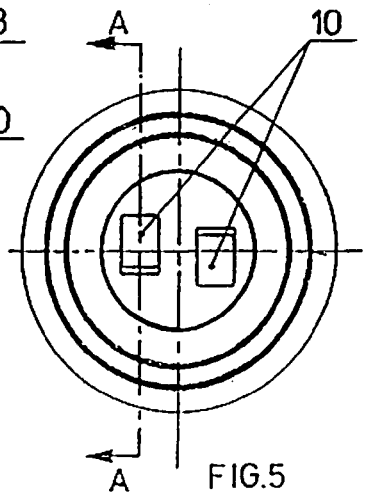

FIGS. 1 and 2 show the situation when the cup 2 is screwed on the body 1 to the position of contact the rings 12 and 13 with the surfaces encircling them, without deformations of the rings. Between the face of the flange 11 and the face of the body 1 there is a slot of size s1. When the nut 2 is fully tightened to the body 1—FIG. 3—axial deformation Δ of the rear sealing ring 13 is approximately 27% of the diameter D, while the gap dimension decreases to s2, a bit smaller than the deformation Δ. For specific material-dimensional terms, high accuracy of numerically controlled machine and experimentally determined value of torque—the position of fully tightening of the nut 2 is defined repeatedly by tightening the nut 2 on the thread runout zone 18 on the body 1. It is advantageous if in this position the face of the nut 2 is tangent to an abutment flange 19 made on the outer surface of the body 1.

The swirl insert 4 in this water nozzle is made of industrial ceramics. However, it is obvious that for specific conditions suitable material is selected, suitable due to erosivity of atomized liquid and its pressure, which enables making both the nut 2—instead of the above described example with the ceramic fitting 3 glued inside—and the swirl insert 4 as a single pieces of metal, for example brass.

Figure 6:
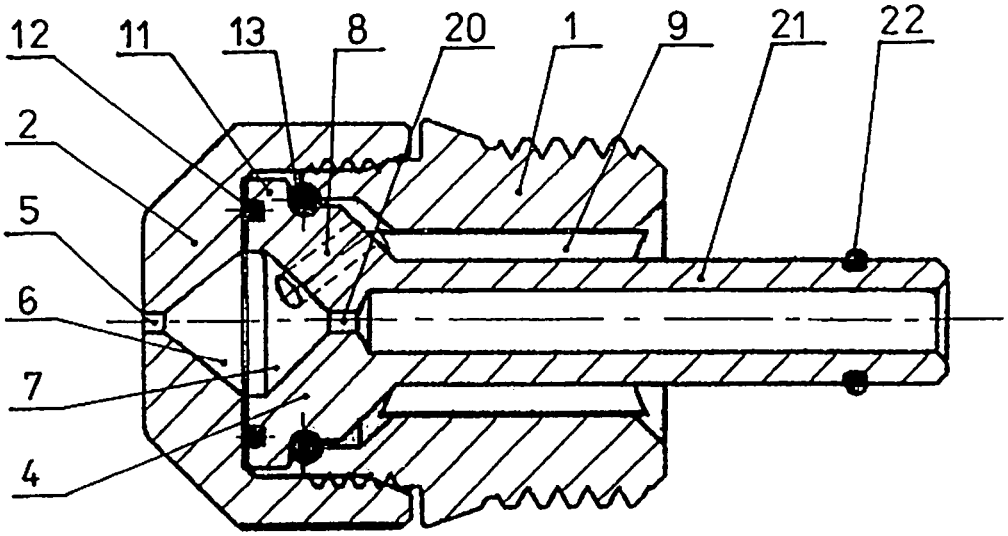
FIG. 6 is an axial-section of the nucleation nozzle, in the position before the full tightening of the nut, when the elements are in non-force contact.
Figure 7:
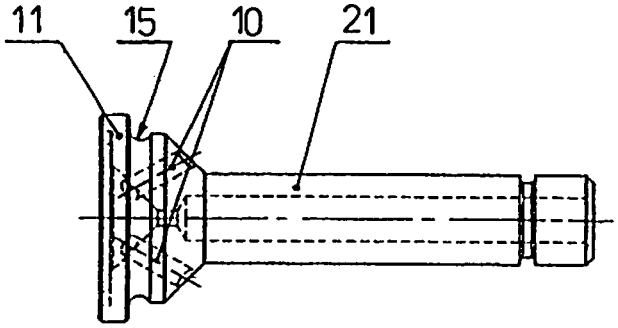
FIGS. 7 and 8 show the swirl insert having an air nozzle and a pipe, respectively: a side view and a front view.
Figure 8:
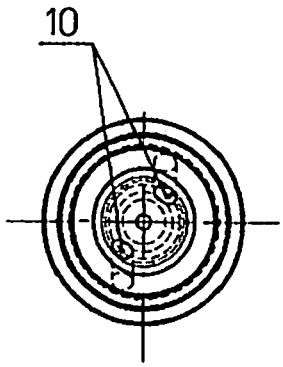

FIGS. 6, 7 and 8 show the second embodiment of the nozzle according to the invention, in which the spraying nozzle is supplied with water by the energy of compressed air. The nozzle like in a snow production cannon forms liquid into fine particles and produces small ice crystals which in snow cannons act as nucleatory, the ice crystal nuclei which initiate the crystallization process of sprayed water. The nozzle of the second version of the invention differs only in this that compressed air is supplied through an air nozzle 20 which is made in the axis of the partition wall 8 of the swirl nozzle 4. The swirl nozzle 4 is permanently connected to a pipe 21, the outside diameter of which is less than the diameter of the fluid inlet supply channel 9. Said pipe 21 extends from the back of the body 1 to the outsides and this extended end having a sealing ring 22 is mounted into the socket of pressed air supply channel made in the ring of cylinder of an snow production cannon. The socked is not visible on the drawing.

LIST OF INDICATIONS

1. cylindrical body
2. cup nut
3. ceramic fitting
4. swirl insert
5. spraying hole
6. inlet cone
7. vortex chamber
8. wall
9. fluid supply channel
10. vortex channel
11. flange
12. front sealing ring
13. rear sealing ring
14. groove
15. semicircular socket
16. quadrant-of-a-circle socket
17. cone input
18. thread runout zone
19. abutment flange
20. air nozzle
21. pipe
22. sealing ring
d. the diameter of the cross section of the front sealing ring
D. the diameter of the cross-section of the rear sealing ring
Δ. axial deformation of the rear sealing ring
s1. slot in the position of contact of elements
s2. slot in the position of full tightening of the nut

The invention claimed is:

1. Nozzle for spraying liquid in a snow production cannon consisting of a cylindrical body (1) and a cap nut (2) having an axial spraying hole (5) connected from inside by an inlet cone (6) to a vortex chamber (7) and having a swirl insert (4) mounted between the body (1) and the nut (2) which divides a fluid supply channel (9) with a wall (8) having at least two vortex channels (10) and the axes of said channels are situated symmetrically and swirly-obliquely around the axis of the nozzle and at the same time the body, the nut and the swirl insert are threaded connection tightened through elastomeric material having flexible-elastic characteristic, characterized by that the swirl insert (4) has a flange (11) with which said insert is axially fixed between the nut (2) and the body (1) through a front (12) and a rear (13) sealing rings, and both of said rings have circular cross-section and the front sealing ring (12) is mounted in a rectangular groove (14) made on the face of the swirl insert (4) and said face is adjacent to the face of the nut (2), and the rear sealing ring (13) is mounted in a semicircular socket (15) made at the inner corner of the rear surface of the flange (11), moreover from the side of the body (1) the rear sealing ring (13) is encircled by a quadrant-of-a-circle socket (16), having a cone input (17) and in the position of tightening of the nut (2) an axial deformation Δ of the rear sealing ring (13) is from 20 to 40% of the diameter D of its cross-section, while the dimension of the gap s2 between the faces of the flange (11) and the body (1) is no greater than the deformation Δ, in addition, the rear sealing ring (13) is made of elastomer having hardness of 60-90 IRHD and its hardness is greater than the hardness of the front sealing ring (12).

2. Nozzle according to claim 1 characterized in that position of full tightening of the nut (2) is determined by tightening the thread of the nut (2) on a thread runout zone (18) on the body (1) at the determined value of torque.

3. Nozzle according to claim 1 characterized in that the position of the full tightening of the nut (2) is determined by contact of the face of the nut (2) and an abutment flange (19) made on external surface of the body (1).

4. Nozzle according to claim 1 characterized in that the nut (2) has a fitting (3) pasted inside its cup, said fitting is made of ceramics or sintered powders and it has a spraying hole (5), an inlet cone (6) and a flange which ring face is tangent to the face of the swirl insert (4).

5. Nozzle according to claim 1 characterized in that the swirl insert (4) is made of ceramics or sintered powders.

6. Nozzle according to claim 1 characterized in that the swirl insert (4) in the axis of the wall (8) has an air nozzle (20) which is supplied by a coaxial pipe (21) the outside diameter (10) of which is less than the diameter of the fluid inlet supply channel (9) and said pipe (21) extends from the back of the body (1) to the outsides.

7. Nozzle according to claim 1 wherein the liquid is water.

8. Nozzle according to claim 1 characterized in that the nut (2) contains a cup with a fitting (3) inside the cup, said fitting is made of ceramics or sintered powders, having a spraying hole (5), an inlet cone (6) and a flange with ring face tangent to the face of the swirl insert (4).

* * * * *

UNITED STATES PATENT AND TRADEMARK OFFICE

CERTIFICATE OF CORRECTION

PATENT NO. : 9,091,472 B2
APPLICATION NO. : 14/003819
DATED : July 28, 2015
INVENTOR(S) : Damian Dziubasik and Tomasz Janos It is certified that error appears in the above-identified patent and that said Letters Patent is hereby corrected as shown below:

Title Page

(71) Applicants should read: -- Damian Dziubasik, Białka Tatrzańska (PL);
Tomasz Janos, Dębno (PL) --.

(72) Inventors should read: -- Damian Dziubasik, Białka Tatrzańska (PL);
Tomasz Janos, Dębno (PL) --.

Signed and Sealed this
Twenty-fourth Day of November, 2015

Michelle K. Lee

Michelle K. Lee
*Director of the United States Patent and Trademark Office*